US007942688B2

(12) United States Patent
Ferderer et al.

(10) Patent No.: US 7,942,688 B2
(45) Date of Patent: May 17, 2011

(54) LOCKING DEVICE

(75) Inventors: Albert Ferderer, Espelkamp (DE); Frank Quast, Bielefeld (DE)

(73) Assignee: Harting Electric GmbH & Co. KG (DE)

( * ) Notice: Subject to any disclaimer, the term of this patent is extended or adjusted under 35 U.S.C. 154(b) by 0 days.

(21) Appl. No.: 12/723,373

(22) Filed: Mar. 12, 2010

(65) Prior Publication Data

US 2010/0248513 A1 Sep. 30, 2010

(30) Foreign Application Priority Data

Mar. 26, 2009 (DE) ..... 20 2009 004 249 U

(51) Int. Cl.
*H01R 13/62* (2006.01)

(52) U.S. Cl. ..... 439/372

(58) Field of Classification Search ..... 439/372, 439/373

See application file for complete search history.

(56) References Cited

U.S. PATENT DOCUMENTS

| | | | | |
|---|---|---|---|---|
| 5,658,162 | A | 8/1997 | Harting et al. | 439/372 |
| 7,258,557 | B2 * | 8/2007 | Matsubara et al. | 439/157 |
| 7,717,723 | B2 * | 5/2010 | Nehm | 439/157 |

FOREIGN PATENT DOCUMENTS

| | | |
|---|---|---|
| DE | 29 15 574 | 10/1980 |
| DE | 89 08 016 | 8/1989 |
| DE | 199 61 708 | 8/2001 |
| DE | 10 2004 011509 | 9/2005 |
| DE | 10 2004 061046 | 7/2006 |
| EP | 0 352 579 | 1/1990 |
| EP | 0 731 534 | 9/1996 |

OTHER PUBLICATIONS

European Search Report dated Aug. 18, 2010, Patent No. 10002973. 5-2214, (4 pgs).

* cited by examiner

*Primary Examiner* — Phuong K Dinh
(74) *Attorney, Agent, or Firm* — Hayes Soloway P.C.

(57) ABSTRACT

The invention proposes a locking device for a two-part connector housing. This locking device consists of two locking elements in connection with an actuating handle. The locking elements respectively consist of a one-piece wire element and feature on one end a part that is shaped in the form of an open eyelet and serves for encompassing a bearing pin of a first connector housing half. On the other end, they feature a part that is shaped in the form of an indentation and serves for producing a snap connection with a locking pin of the second connector housing half. Since the locking elements are manufactured of a flexible spring steel wire, they can be elastically bent such that they can be pushed over the bearing pins of an existing connector housing half and engaged at this location in order to allow the retrofitting of an already installed connector with a locking device with superior environmental resistance.

15 Claims, 2 Drawing Sheets

LOCKING DEVICE

BACKGROUND OF THE INVENTION

1. Field of the Invention

The invention pertains to a locking device for connector housings that comprises an actuating handle and two locking elements that are rotatable on two bearing pins arranged on a first connector housing half and lockable on two locking pins arranged on a second connector housing half, wherein the two locking elements respectively consist of a one-piece wire element.

A locking device of this type is required for connecting two connector housing halves to one another in an environmentally protected fashion.

2. Description of the Related Art

Publication DE 29 15 574 C2 discloses a housing half closure for multipolar electric connectors with one or even two locking clips that can be pivoted about bearing pins of a lower housing part and are manufactured of the spring steel wire. Such a locking clip is provided with eyelets, a first spring section that is bent in an Ω-like fashion, a catch hook with a slide-on curvature and a second spring section that is bent in an Ω-like fashion. It is furthermore disclosed that a handle part is snapped onto the locking clip. During the closing process, the opening width of the first Ω-like spring section is increased by a force acting upon the connecting section. This causes slide-on curvatures of the locking clip to be bent upward such that they can slide over a bearing pin of the upper housing part. In addition, the unlocking process is also simplified with the proposed housing half closure.

Such a device requires a high elasticity of the locking clip that, in turn, reduces the locking forces. This device therefore is also not stable with respect to its handling.

EP 0 731 534 B1 discloses an electric connector, in which a U-shaped locking clip that can be pivoted about bearing pins of one connector half features pockets in its lateral parts, wherein a specially shaped spring element is respectively arranged in said pockets and makes it possible to lock the connector in cooperation with a locking pin arranged on the second housing half. Such a locking device requires many individual small parts and the manufacture of the locking clip is relatively complicated.

In other locking devices of this design, the locking clips are essentially manufactured of an elastic plastic material and can be elastically bent in such a way that they can be pushed over the bearing pins of an existing connector housing half and engaged at this location. However, these locking clips do not have a sufficient environmental resistance for many applications and are, in particular, not sufficiently heat-resistant for many applications such as, for example, in the vicinity of a blast furnace during the operation thereof.

In the past, it was determined that the locking devices of connectors exhibit particularly significant wear, especially under extreme environmental conditions such as, for example, heat or humidity. These wear phenomena frequently do not manifest themselves until the connector is installed at the site of operation. Consequently, one disadvantage of the state of the art can be seen in that it is impossible or requires great effort to exchange the original locking devices of existing connectors with corresponding locking devices that are more environmentally resistant and, in particular, more heat-resistant.

SUMMARY OF THE INVENTION

The invention therefore is based on the objective of developing a locking device for two matching connector housing halves that is designed in the simplest mechanical and most cost-efficient fashion possible and does not exhibit the aforementioned disadvantages.

This objective is attained in that each locking element is realized in the form of a C-shaped limb with two limb ends that are initially bent inward and can then be connected to the actuating handle in a parallel alignment such that they perpendicularly intersect the C-shaped limb, wherein the limb features on the first limb end a part that is realized in the form of an open eyelet and serves for encompassing one of the two bearing pins, and wherein the limb features on the second limb end a bend, the end region of which is provided as a slide-on curvature, as well as a part that is realized in the form of an indentation and serves for producing a snap connection with one of the two locking pins of the second connector housing half.

The invention concerns a locking device for connector housings, particularly so-called "heavy-duty connectors," in which it must be possible to lock the two housing halves relative to one another in such a way that an environmentally safe protection of internal connector elements is ensured.

The separable connection between the respective locking element and the actuating handle is advantageously suitable for arranging a new, environmentally resistant locking device on an already existing connector system in an unproblematic fashion such that the retrofitting of existing connector systems is significantly simplified.

Consequently, it is particularly advantageous that such a locking device can be subsequently installed, for example, at the site of operation and on already installed housing halves. This significantly simplifies the exchange of a locking device that is not as environmentally resistant with a locking device that has a correspondingly superior environmental resistance.

Another advantage attained with the invention can be seen in that the locking device features an exchangeable actuating handle, into which two locking elements that are mirror-symmetrical to one another can be inserted and engaged therein.

As described further below, the locking device makes it possible to achieve a particularly advantageous ratio between actuating and retention forces. During the locking process, the end piece leading to the first limb end is elastically bent away from the bearing pin by means of a corresponding actuation of the actuating handle and the end piece leading to the second limb end simultaneously is elastically bent toward the corresponding locking pin. A lifting of the slide-on curvatures consequently is ensured such that they can slide over the locking pins during the locking process with comparatively little effort. The thusly achieved particularly advantageous ratio between actuating and retention forces is very important, particularly with respect to heavy-duty connectors, because an environmentally safe protection of the internal connector elements is ensured due to the high retention forces.

Practical experience also showed that the actuating forces during the locking process represent the actual problem in certain connector arrangements while the actuating forces during the unlocking process are comparatively less problematic. Consequently, the optimization of the locking device with respect to a reduction of the actuating forces during the locking process is particularly advantageous for such a connector arrangement.

The wire elements furthermore may be advantageously manufactured in the form of bent wire parts of spring steel wire.

The actuating handle may be realized in the form of an L-shaped extruded section with a continuous oblong hole.

This makes it possible to saw several handles from one section with little effort and to arrange locking springs in the ends of the handles in a captive fashion.

BRIEF DESCRIPTION OF THE DRAWINGS

One exemplary embodiment of the invention is illustrated in the drawings and described in greater detail below. The figures show.

DESCRIPTION OF THE PREFERRED EMBODIMENTS

Figure 1A:
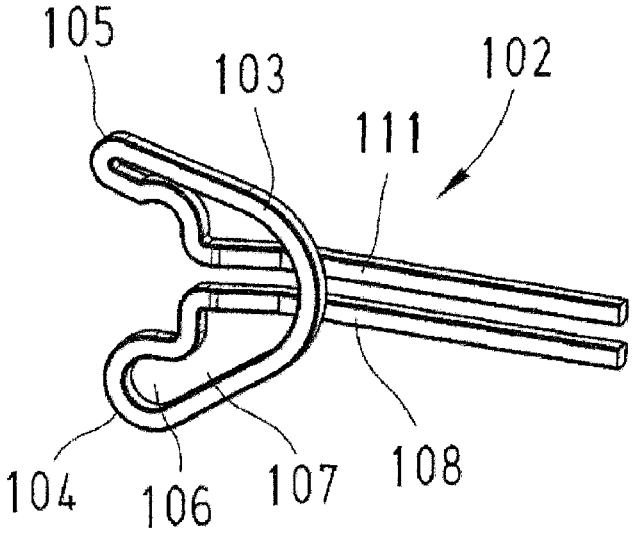
FIG. 1*a* is a non-angled locking element.

A locking device 100 comprises an actuating handle 101 with locking elements 102, 102' attached to both sides thereof. Such a locking element 102 is illustrated in the form of an individual part in the non-angled state in FIG. 1*a* and in the angled state in FIG. 1*b*.

The locking element 102 consists of a one-piece spring steel wire and features a C-shaped limb 103 with a first limb end 104 and a second limb end 105.

On the first limb end 104, the locking element is bent inward into an open eyelet 106. The eyelet 106 is followed by an eyelet opening 107, within which the locking element is bent away from the C-shaped limb 103. The locking element furthermore features another bend, due to which the locking element perpendicularly intersects the C-shaped limb 103 in a first end section 108.

On the second limb end 105, the locking element is bent inward by 180° in the shape of a segment of a circle with a suitable curvature radius. The end of this bend forms a slide-on curvature 109. After a short straight section, the locking element features an indentation 110 that also extends in the shape of a segment of a circle. After the indentation 110, the locking element features another bend, due to which it extends parallel to the first end section 108 in a second end section 111 and perpendicularly intersects the C-shaped limb 103.

Figure 1B:
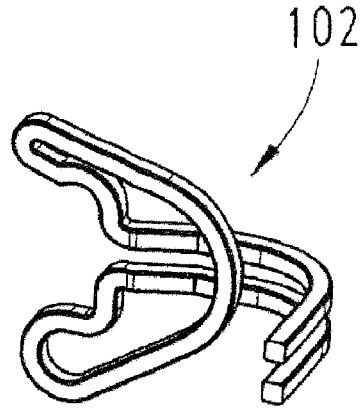
FIG. 1*b* is an angled locking element.

According to FIG. 1*b*, the two parallel end sections 108, 111 are bent perpendicular to a plane formed by the C-shape and therefore suitable for being connected to one side of the actuating handle 101.

In another proposed variation, the two end sections 108, 111 are not bent. In this variation, the end sections are also suitable for being connected to a correspondingly designed actuating handle.

Figure 2:
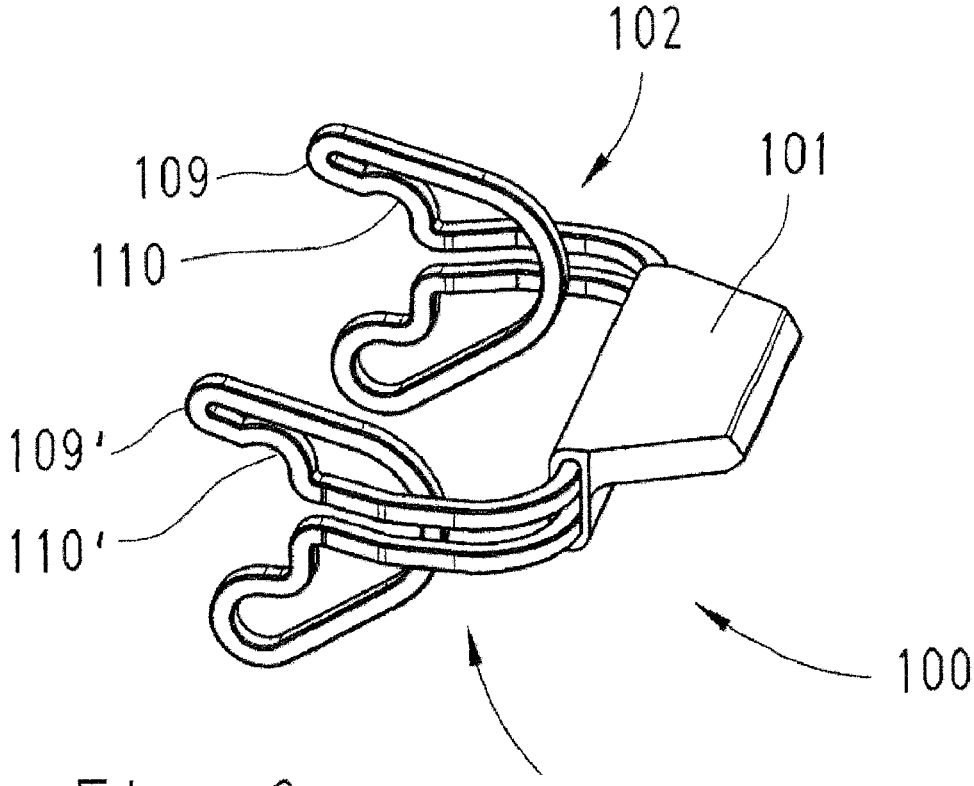
FIG. 2 is a locking device.

FIG. 2 shows the locking device 100 consisting of an actuating handle 101 and two locking elements 102, 102' attached thereto.

Figure 3:
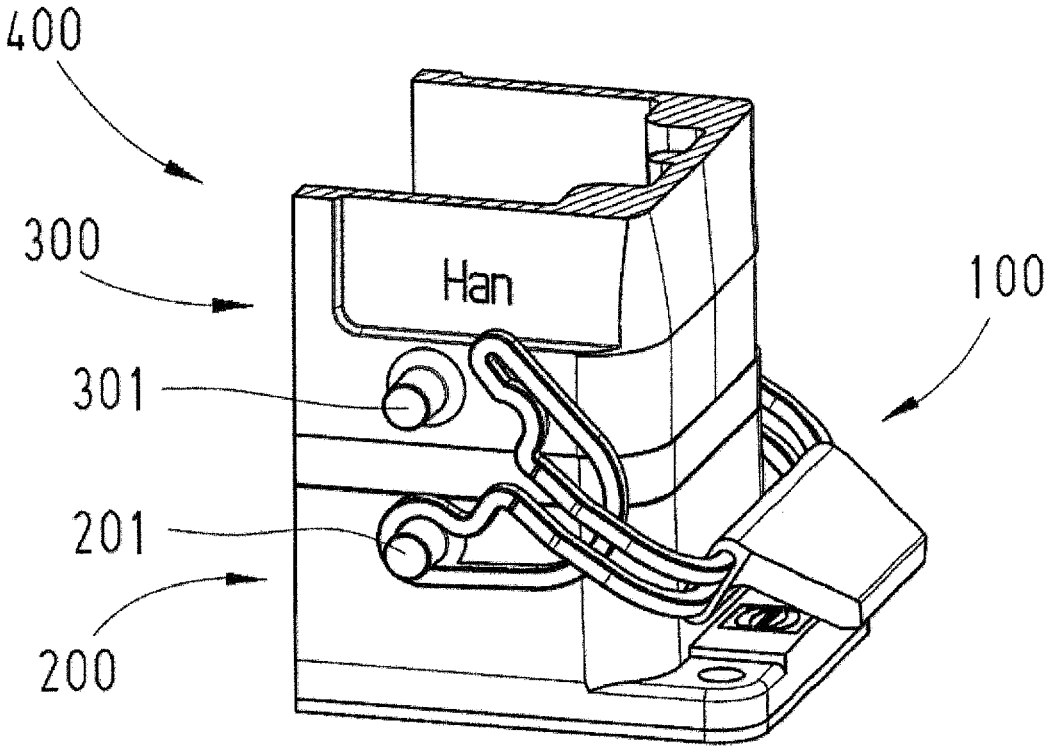
FIG. 3 is a connector housing with a locking device in the unlocked state.

FIG. 3 shows a connector housing 400 with the locking device 100 in the unlocked state. In this case, the connector housing 400 consists of a first connector housing half 200 with two bearing pins 201 and a second connector housing half 300 with two locking pins 301. When the actuating handle 101 is lifted and the second limb end 105 comes in contact with the corresponding locking pin 301, the first end section 108 is elastically bent away from the bearing pin 201 and the second end section 111 simultaneously is elastically bent toward the locking pin 301. Consequently, a lifting of the slide-on curvature 109 is ensured such that it can slide over the corresponding locking pin 301 during the locking process with comparatively little effort.

Figure 4:
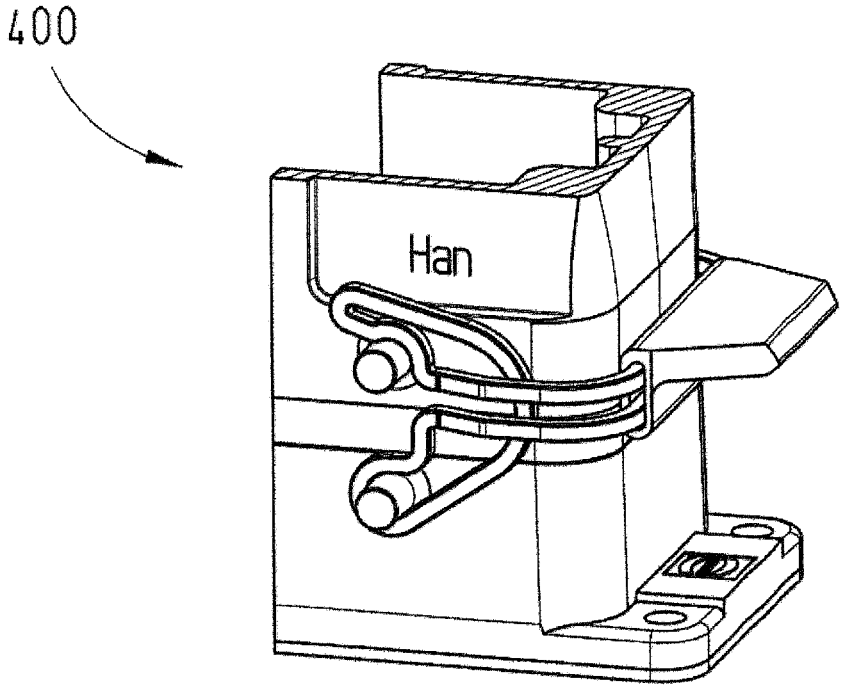
FIG. 4 is a locked connector housing.

FIG. 4 shows a connector housing 400 that is locked in this fashion.

What is claimed is:

1. A locking device for connector housings, comprising an actuating handle and two locking elements that are rotatable on two bearing pins arranged on a first connector housing half and lockable on two locking pins arranged on a second connector housing half, wherein the two locking elements respectively consist of a one-piece wire element, wherein each locking element is realized in the form of a C-shaped limb with two limb ends that are initially bent inward and can then be connected to the actuating handle in a parallel alignment such that they perpendicularly intersect the C-shaped limb, wherein the limb features on the first limb end a part that is realized in the form of an open eyelet and serves for encompassing one of the two bearing pins, and wherein the limb features on the second limb end a bend, the end region of which is provided as a slide-on curvature, as well as a part that is realized in the form of an indentation and serves for producing a snap connection with one of the two locking pins of the second connector housing half.

2. The locking device according to claim 1, wherein the two end sections of the locking element are bent perpendicular to a plane formed by the C-shaped limb.

3. The locking device according to claim 1, wherein the connection of the end pieces with the actuating handle can be produced by inserting and engaging.

4. The locking device according to claim 1, wherein the end sections are connected to the actuating handle.

5. The locking device according to claim 1, wherein the connection of the end sections with the actuating handle is inseparable.

6. The locking device according to claim 1, wherein the two locking elements are mirror-symmetrical to one another.

7. The locking device according to claim 1, wherein the slide-on curvature has the shape of a segment of a circle.

8. The locking device according to claim 1, wherein the indentation has the shape of a segment of a circle.

9. The locking device according to claim 2, wherein the actuating handle is realized in the form of an L-shaped extruded section.

10. The locking device according to claim 3, wherein the actuating handle is realized in the form of an L-shaped extruded section.

11. The locking device according to claim 4, wherein the actuating handle is realized in the form of an L-shaped extruded section.

12. The locking device according to claim 5, wherein the actuating handle is realized in the form of an L-shaped extruded section.

13. The locking device according to claim 6, wherein the actuating handle is realized in the form of an L-shaped extruded section.

14. The locking device according to claim 7, wherein the actuating handle is realized in the form of an L-shaped extruded section.

15. The locking device according to claim 8, wherein the actuating handle is realized in the form of an L-shaped extruded section.

* * * * *